US008904730B2

(12) United States Patent
Hohmann, Jr.

(10) Patent No.: US 8,904,730 B2
(45) **Date of Patent: *Dec. 9, 2014**

(54) THERMALLY-ISOLATED ANCHORING SYSTEMS FOR CAVITY WALLS

(75) Inventor: Ronald P. Hohmann, Jr., Hauppauge, NY (US)

(73) Assignee: Mitek Holdings, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/426,176

(22) Filed: Mar. 21, 2012

(65) Prior Publication Data

US 2013/0247483 A1 Sep. 26, 2013

(51) Int. Cl.
*E04B 1/38* (2006.01)

(52) U.S. Cl.
USPC ..... 52/714; 52/379

(58) Field of Classification Search
CPC ..... E04B 1/4178; E04B 1/4185
USPC ..... 52/378, 379, 383, 508, 513, 565, 716, 52/714, 506.01, 506.05, 713
See application file for complete search history.

(56) References Cited

U.S. PATENT DOCUMENTS

| | | | |
|---|---|---|---|
| 819,869 | A | 5/1906 | Dunlap |
| 903,000 | A | 11/1908 | Priest, Jr. |
| 1,170,419 | A | 2/1916 | Coon et al. |
| RE15,979 | E | 1/1925 | Schaefer et al. |
| 1,794,684 | A | 3/1931 | Handel |
| 1,936,223 | A | 11/1933 | Awbrey |
| 2,058,148 | A | 10/1936 | Hard |
| 2,097,821 | A | 11/1937 | Mathers |
| 2,280,647 | A | 4/1942 | Hawes |
| 2,300,181 | A | 10/1942 | Spaight |
| 2,403,566 | A | 7/1946 | Thorp et al. |
| 2,413,772 | A | 1/1947 | Morehouse |
| 2,605,867 | A | 8/1952 | Goodwin |
| 2,780,936 | A | 2/1957 | Hillberg |
| 2,898,758 | A | 8/1959 | Henrickson |
| 2,929,238 | A | 3/1960 | Kaye |
| 2,966,705 | A | 1/1961 | Massey |
| 2,999,571 | A | 9/1961 | Huber |

(Continued)

FOREIGN PATENT DOCUMENTS

| | | |
|---|---|---|
| CH | 279209 4 B | 3/1952 |
| EP | 0199595 B1 | 3/1995 |

(Continued)

OTHER PUBLICATIONS

Building Envelope Requirements, 780 CMR sec. 1304.0 et seq., 7th Edition, Aug. 28, 2008, 11 pages, Boston, MA, United States.

(Continued)

*Primary Examiner* — Jeanette E Chapman
*Assistant Examiner* — James Buckle, Jr.
(74) *Attorney, Agent, or Firm* — Silber & Fridman

(57) ABSTRACT

A high-strength thermally-isolating surface-mounted anchoring system for a cavity wall is disclosed. The thermally-isolated anchoring system is adaptable to varied structures, including high-span applications, and for use with interlocking veneer ties and reinforcement wires. The anchoring system includes an anchor base and a stepped cylinder which sheaths the mounting hardware to limit insulation tearing and resultant loss of insulation integrity. The anchoring system is thermally-isolated through the use of a series of strategically placed compressible nonconductive fittings. Seals are formed which preclude penetration of air, moisture, and water vapor into the wall structure.

20 Claims, 5 Drawing Sheets

(56) References Cited

U.S. PATENT DOCUMENTS 3,030,670 A 4/1962 Bigelow
3,183,628 A 5/1965 Smith
3,254,736 A 6/1966 Gass
3,277,626 A 10/1966 Brynjolfsson et al.
3,300,939 A 1/1967 Brynjolfsson et al.
3,309,828 A 3/1967 Tribble
3,310,926 A 3/1967 Brandreth et al.
3,341,998 A 9/1967 Lucas
3,377,764 A 4/1968 Storch
3,478,480 A 11/1969 Swenson
3,563,131 A 2/1971 Ridley, Sr.
3,568,389 A 3/1971 Gulow
3,640,043 A 2/1972 Querfeld et al.
3,964,226 A 6/1976 Hala et al.
3,964,227 A 6/1976 Hala
4,021,990 A 5/1977 Schwalberg
4,227,359 A 10/1980 Schlenker
4,238,987 A 12/1980 Siebrecht-Reuter
4,305,239 A 12/1981 Geraghty
4,373,314 A 2/1983 Allan
4,382,416 A 5/1983 Kellogg-Smith
4,424,745 A 1/1984 Magorian et al.
4,438,611 A 3/1984 Bryant
4,473,984 A 10/1984 Lopez
4,482,368 A 11/1984 Roberts
4,571,909 A 2/1986 Berghuis et al.
4,596,102 A 6/1986 Catani et al.
4,598,518 A 7/1986 Hohmann
4,606,163 A 8/1986 Catani
4,622,796 A 11/1986 Aziz et al.
4,628,657 A 12/1986 Ermer et al.
4,636,125 A 1/1987 Burgard
4,640,848 A 2/1987 Cerdan-Diaz et al.
4,660,342 A 4/1987 Salisbury
4,703,604 A 11/1987 Muller
4,708,551 A 11/1987 Richter et al.
4,738,070 A 4/1988 Abbott et al.
4,764,069 A 8/1988 Reinwall et al.
4,819,401 A 4/1989 Whitney, Jr.
4,827,684 A 5/1989 Allan
4,843,776 A 7/1989 Guignard
4,852,320 A 8/1989 Ballantyne
4,869,038 A 9/1989 Catani
4,869,043 A 9/1989 Hatzinikolas et al.
4,875,319 A 10/1989 Hohmann
4,911,949 A 3/1990 Iwase et al.
4,922,680 A 5/1990 Kramer
4,946,632 A 8/1990 Pollina
4,955,172 A 9/1990 Pierson
5,063,722 A 11/1991 Hohmann
5,099,628 A 3/1992 Noland et al.
5,207,043 A 5/1993 McGee et al.
5,307,602 A 5/1994 Lebraut
5,392,581 A 2/1995 Hatzinikolas et al.
5,408,798 A 4/1995 Hohmann
5,440,854 A 8/1995 Hohmann
5,454,200 A 10/1995 Hohmann
5,456,052 A 10/1995 Anderson et al.
5,490,366 A 2/1996 Burns et al.
5,598,673 A 2/1997 Atkins
5,634,310 A 6/1997 Hohmann
5,669,592 A 9/1997 Kearful
5,671,578 A 9/1997 Hohmann
5,673,527 A 10/1997 Coston et al.
5,755,070 A 5/1998 Hohmann
5,816,008 A 10/1998 Hohmann
5,819,486 A 10/1998 Goodings
5,845,455 A 12/1998 Johnson, III
6,000,178 A 12/1999 Goodings
6,125,608 A 10/2000 Charlson
6,209,281 B1 4/2001 Rice
6,279,283 B1 8/2001 Hohmann et al.
6,284,311 B1 9/2001 Gregorovich et al.
6,332,300 B1 12/2001 Wakai
6,351,922 B1 3/2002 Burns et al.
6,367,219 B1 4/2002 Quinlan
6,612,343 B2 9/2003 Camberlin et al.
6,627,128 B1 9/2003 Boyer
6,668,505 B1 12/2003 Hohmann et al.
6,686,301 B2 2/2004 Li et al.
6,735,915 B1 5/2004 Johnson, III
6,739,105 B2 5/2004 Fleming
6,789,365 B1 9/2004 Hohmann et al.
6,817,147 B1 11/2004 MacDonald
6,827,969 B1 12/2004 Skoog et al.
6,837,013 B2 1/2005 Foderberg et al.
6,851,239 B1 2/2005 Hohmann et al.
6,925,768 B2 8/2005 Hohmann et al.
6,941,717 B2 9/2005 Hohmann et al.
6,968,659 B2 11/2005 Boyer
7,007,433 B2 3/2006 Boyer
7,017,318 B1 3/2006 Hohmann et al.
7,043,884 B2 5/2006 Moreno
7,059,577 B1 6/2006 Burgett
D527,834 S 9/2006 Thimons et al.
7,147,419 B2 12/2006 Di Vinadio
7,152,382 B2 12/2006 Johnson, III
7,171,788 B2 2/2007 Bronner
7,178,299 B2 2/2007 Hyde et al.
D538,948 S 3/2007 Thimons et al.
7,225,590 B1 6/2007 diGirolamo et al.
7,325,366 B1 2/2008 Hohmann, Jr. et al.
7,334,374 B2 2/2008 Schmid
7,374,825 B2 5/2008 Hazel et al.
7,415,803 B2 8/2008 Bronner
7,469,511 B2 12/2008 Wobber
7,481,032 B2 1/2009 Tarr
7,552,566 B2 6/2009 Hyde et al.
7,562,506 B2 7/2009 Hohmann, Jr.
7,587,874 B2 9/2009 Hohmann, Jr.
7,735,292 B2 6/2010 Massie
7,748,181 B1 7/2010 Guinn
7,788,869 B2 9/2010 Voegele, Jr.
D626,817 S 11/2010 Donowho et al.
7,845,137 B2 12/2010 Hohmann, Jr.
8,037,653 B2 10/2011 Hohmann, Jr.
8,051,619 B2 11/2011 Hohmann, Jr.
8,096,090 B1 1/2012 Hohmann, Jr. et al.
8,109,706 B2 2/2012 Richards
8,122,663 B1 2/2012 Hohmann, Jr. et al.
8,201,374 B2 6/2012 Hohmann, Jr.
8,209,934 B2 7/2012 Pettingale
8,215,083 B2 7/2012 Toas et al.
8,291,672 B2 10/2012 Hohmann, Jr. et al.
8,347,581 B2 1/2013 Doerr et al.
8,375,667 B2 2/2013 Hohmann, Jr.
8,418,422 B2 4/2013 Johnson, III
8,511,041 B2 8/2013 Fransen
8,516,763 B2 8/2013 Hohmann, Jr.
8,516,768 B2 8/2013 Johnson, III
8,544,228 B2 10/2013 Bronner
8,555,587 B2 10/2013 Hohmann, Jr.
8,555,596 B2 10/2013 Hohmann, Jr.
8,596,010 B2 12/2013 Hohmann, Jr.
8,613,175 B2 12/2013 Hohmann, Jr.
8,667,757 B1 3/2014 Hohmann, Jr.
2001/0054270 A1 12/2001 Rice
2002/0100239 A1 8/2002 Lopez
2003/0121226 A1 7/2003 Bolduc
2003/0217521 A1 11/2003 Richardson et al.
2004/0083667 A1 5/2004 Johnson, III
2004/0216408 A1 11/2004 Hohmann, Jr.
2004/0216413 A1 11/2004 Hohmann et al.
2004/0216416 A1 11/2004 Hohmann et al.
2004/0231270 A1 11/2004 Collins et al.
2005/0279043 A1 12/2005 Bronner
2006/0198717 A1 9/2006 Fuest
2006/0242921 A1 11/2006 Massie
2006/0251916 A1 11/2006 Arikawa et al.
2008/0092472 A1 4/2008 Doerr et al.
2008/0141605 A1 6/2008 Hohmann
2008/0222992 A1 9/2008 Hikai et al.
2009/0133351 A1 5/2009 Wobber
2009/0133357 A1 5/2009 Richards

(56) References Cited

U.S. PATENT DOCUMENTS

| | | | |
|---|---|---|---|
| 2010/0037552 | A1 | 2/2010 | Bronner |
| 2010/0071307 | A1 | 3/2010 | Hohmann, Jr. |
| 2010/0101175 | A1 | 4/2010 | Hohmann |
| 2010/0192495 | A1 | 8/2010 | Huff et al. |
| 2010/0257803 | A1 | 10/2010 | Hohmann, Jr. |
| 2011/0023748 | A1 | 2/2011 | Wagh et al. |
| 2011/0041442 | A1 | 2/2011 | Bui |
| 2011/0047919 | A1 | 3/2011 | Hohmann, Jr. |
| 2011/0061333 | A1 | 3/2011 | Bronner |
| 2011/0083389 | A1 | 4/2011 | Bui |
| 2011/0146195 | A1 | 6/2011 | Hohmann, Jr. |
| 2011/0173902 | A1 | 7/2011 | Hohmann, Jr. et al. |
| 2011/0277397 | A1 | 11/2011 | Hohmann, Jr. |
| 2012/0186183 | A1 | 7/2012 | Johnson, III |
| 2012/0285111 | A1 | 11/2012 | Johnson, III |
| 2013/0008121 | A1 | 1/2013 | Dalen |
| 2013/0074435 | A1 | 3/2013 | Hohmann, Jr. |
| 2013/0232893 | A1 | 9/2013 | Hohmann, Jr. |
| 2013/0232909 | A1 | 9/2013 | Curtis et al. |
| 2013/0247482 | A1 | 9/2013 | Hohmann, Jr. |
| 2013/0247484 | A1 | 9/2013 | Hohmann, Jr. |
| 2013/0247498 | A1 | 9/2013 | Hohmann, Jr. |
| 2013/0340378 | A1 | 12/2013 | Hohmann, Jr. |
| 2014/0000211 | A1 | 1/2014 | Hohmann, Jr. |

FOREIGN PATENT DOCUMENTS

| | | |
|---|---|---|
| GB | 1575501 | 9/1980 |
| GB | 2069024 A | 8/1981 |
| GB | 2246149 A | 1/1992 |
| GB | 2265164 A | 9/1993 |
| GB | 2459936 B | 3/2013 |

OTHER PUBLICATIONS

Hohmann & Barnard, Inc.; Product Catalog, 2003, 44 pages, Hauppauge, New York, United States.

Hohmann & Barnard, Inc.; Product Catalog, 2009, 52 pages, Hauppauge, New York, United States.

ASTM Standard E754-80 (2006), Standard Test Method for Pullout Resistance of Ties and Anchors Embedded in Masonry Mortar Joints, ASTM International, 8 pages, West Conshohocken, Pennsylvania, United States.

ASTM Standard Specification A951/A951M-11, Table 1, Standard Specification for Steel Wire for Masonry Joint Reinforcement, Nov. 14, 2011, 6 pages, West Conshohocken, Pennsylvania, United States.

Building Code Requirements for Masonry Structures and Commentary, TMS 402-1/ACI 530-11/ASCE 5-11, 2011, Chapter 6, 12 pages.

Kossecka, Ph.D, et al., Effect of Insulation and Mass Distribution in Exterior Walls on Dynamic Thermal Performance of Whole Buildings, Thermal Envelopes VII/Building Systems—Principles p. 721-731, 1998, 11 pages.

THERMALLY-ISOLATED ANCHORING SYSTEMS FOR CAVITY WALLS

BACKGROUND OF THE INVENTION

1. Field of the Invention

This invention relates to anchoring systems for insulated cavity walls. At the inner wythe, the anchoring systems provide sealing along the dual-diameter barrel of the wall anchor with a first seal covering the insertion site in the wallboard and a second seal covering the opening of the wall anchor channel at the exterior surface of the insulation. At the outer wythe, the anchoring systems provide a variety of veneer ties for angular adjustment, self-leveling, and seismic protection. Besides sealing the wallboard and the insulation, the seals provide support for the wall anchor and substantially preclude lateral movement. The system has application to seismic-resistant structures and to cavity walls having special requirements. The latter include high-strength and high-span requirements for both insulated and non-insulated cavities, namely, a structural performance characteristic capable of withstanding a 100 lbf, in both tension and compression.

2. Description of the Prior Art

In the past, anchoring systems have taken a variety of configurations. Where the applications included masonry backup walls, wall anchors were commonly incorporated into ladder—or truss-type reinforcements and provided wire-to-wire connections with box-ties or pintle-receiving designs on the veneer side.

In the late 1980's, surface-mounted wall anchors were developed by Hohmann & Barnard, Inc., now a MiTEK-Berkshire Hathaway Company, and patented under U.S. Pat. No. 4,598,518. The invention was commercialized under trademarks DW-10®, DW-10-X®, and DW-10-HS®. These widely accepted building specialty products were designed primarily for dry-wall construction, but were also used with masonry backup walls. For seismic applications, it was common practice to use these wall anchors as part of the DW-10® Seismiclip® interlock system which added a Byna-Tie® wire formative, a Seismiclip® snap-in device—described in U.S. Pat. No. 4,875,319 ('319), and a continuous wire reinforcement.

In an insulated dry wall application, the surface-mounted wall anchor of the above-described system has pronged legs that pierce the insulation and the wallboard and rest against the metal stud to provide mechanical stability in a four-point landing arrangement. The vertical slot of the wall anchor enables the mason to have the wire tie adjustably positioned along a pathway of up to 3.625-inch (max.). The interlock system served well and received high scores in testing and engineering evaluations which examined effects of various forces, particularly lateral forces, upon brick veneer masonry construction. However, under certain conditions, the system did not sufficiently maintain the integrity of the insulation. Also, upon the promulgation of regulations requiring significantly greater tension and compression characteristics were raised, a different structure—such as one of those described in detail below—became necessary.

The engineering evaluations further described the advantages of having a continuous wire embedded in the mortar joint of anchored veneer wythes. The seismic aspects of these investigations were reported in the inventor's '319 patent. Besides earthquake protection, the failure of several high-rise buildings to withstand wind and other lateral forces resulted in the incorporation of a continuous wire reinforcement requirement in the Uniform Building Code provisions. The use of a continuous wire in masonry veneer walls has also been found to provide protection against problems arising from thermal expansion and contraction and to improve the uniformity of the distribution of lateral forces in the structure.

Shortly after the introduction of the pronged wall anchor, a seismic veneer anchor, which incorporated an L-shaped backplate, was introduced. This was formed from either 12- or 14-gage sheetmetal and provided horizontally disposed openings in the arms thereof for pintle legs of the veneer anchor. In general, the pintle-receiving sheetmetal version of the Seismiclip interlock system served well, but in addition to the insulation integrity problem, installations were hampered by mortar buildup interfering with pintle leg insertion.

In the 1980's, an anchor for masonry veneer walls was developed and described in U.S. Pat. No. 4,764,069 by Reinwall et al., which patent is an improvement of the masonry veneer anchor of Lopez, U.S. Pat. No. 4,473,984. Here the anchors are keyed to elements that are installed using power-rotated drivers to deposit a mounting stud in a cementitious or masonry backup wall. Fittings are then attached to the stud which include an elongated eye and a wire tie therethrough for deposition in a bed joint of the outer wythe. It is instructive to note that pin-point loading—that is forces concentrated at substantially a single point—developed from this design configuration. This resulted, upon experiencing lateral forces over time, in the loosening of the stud.

Recently there have been significant shifts in public sector building specifications, such as the Energy Code Requirement, Boston, Mass. (see Chapter 13 of 780 CMR, Seventh Edition). This Code sets forth insulation R-values well in excess of prior editions and evokes an engineering response opting for thicker insulation and correspondingly larger cavities. Here, the emphasis is upon creating a building envelope that is designed and constructed with a continuous air barrier to control air leakage into or out of conditioned space adjacent the inner wythe, which have resulted in architects and architectural engineers requiring larger and larger cavities in the exterior cavity walls of public buildings. These requirements are imposed without corresponding decreases in wind shear and seismic resistance levels or increases in mortar bed joint height. Thus, wall anchors are needed to occupy the same ⅜ inch high space in the inner wythe and tie down a veneer facing material of an outer wythe at a span of two or more times that which had previously been experienced.

As insulation became thicker, the tearing of insulation during installation of the pronged DW-10X® wall anchor, see supra, became more prevalent. This occurred as the installer would fully insert one side of the wall anchor before seating the other side. The tearing would occur at two times, namely, during the arcuate path of the insertion of the second leg and separately upon installation of the attaching hardware. The gapping caused in the insulation permitted air and moisture to infiltrate through the insulation along the pathway formed by the tear. While the gapping was largely resolved by placing a self-sealing, dual-barrier polymeric membrane at the site of the legs and the mounting hardware, with increasing thickness in insulation, this patchwork became less desirable. The improvements hereinbelow in surface mounted wall anchors look toward greater insulation integrity and less reliance on a patch.

Another prior art development occurred shortly after that of Reinwall/Lopez when Hatzinikolas and Pacholok of Fero Holding Ltd. introduced their sheetmetal masonry connector for a cavity wall. This device is described in U.S. Pat. Nos. 5,392,581 and 4,869,043. Here a sheetmetal plate connects to the side of a dry wall column and protrudes through the insulation into the cavity. A wire tie is threaded through a slot in the leading edge of the plate capturing an insulative plate thereunder and extending into a bed joint of the veneer. The underlying sheetmetal plate is highly thermally conductive, and the '581 patent describes lowering the thermal conductivity by foraminously structuring the plate. However, as there is no thermal break, a concomitant loss of the insulative integrity results.

Focus on the thermal characteristics of cavity wall construction is important to ensuring minimized heat transfer through the walls, both for comfort and for energy efficiency of heating and air conditioning. When the exterior is cold relative to the interior of a heated structure, heat from the interior should be prevented from passing through the outside. Similarly, when the exterior is hot relative to the interior of an air conditioned structure, heat from the exterior should be prevented from passing through to the interior. Providing a seal at the insertion points of the mounting hardware assists in controlling heat transfer.

In recent building codes for masonry structures, a trend away from eye and pintle structures is seen in that the newer codes require adjustable anchors be detailed to prevent disengagement. This has led to anchoring systems in which the open end of the veneer tie is embedded in the corresponding bed joint of the veneer and precludes disengagement by vertical displacement.

Another application for high-span anchoring systems is in the evolving technology of self-cooling buildings. Here, the cavity wall serves additionally as a plenum for delivering air from one area to another. While this technology has not seen wide application in the United States, the ability to size cavities to match air moving requirements for naturally ventilated buildings enable the architectural engineer to now consider cavity walls when designing structures in this environmentally favorable form.

In the past, the use of wire formatives have been limited by the mortar layer thicknesses which, in turn are dictated either by the new building specifications or by pre-existing conditions, e.g. matching during renovations or additions the existing mortar layer thickness. While arguments have been made for increasing the number of the fine-wire anchors per unit area of the facing layer, architects and architectural engineers have favored wire formative anchors of sturdier wire. On the other hand, contractors find that heavy wire anchors, with diameters approaching the mortar layer height specification, frequently result in misalignment. This led to the low-profile wall anchors of the inventors hereof as described in U.S. Pat. No. 6,279,283. However, the above-described technology did not address the adaption thereof to surface mounted devices or stud-type devices. Nor does it address the need to thermally-isolate the wall anchor.

In the course of preparing this Application, several patents, became known to the inventors hereof and are acknowledged hereby:

| Pat. | Inventor | Issue Date |
|---|---|---|
| 2,058,148 | Hard | October 1936 |
| 2,966,705 | Massey | January 1961 |
| 3,377,764 | Storch | April 1968 |
| 4,021,990 | Schwalberg | May 10, 1977 |
| 4,305,239 | Geraghty | December 1981 |
| 4,373,314 | Allan | Feb. 15, 1983 |
| 4,438,611 | Bryant | March 1984 |
| 4,473,984 | Lopez | Oct. 02, 1984 |
| 4,598,518 | Hohmann | Jul. 08, 1986 |
| 4,869,038 | Catani | Sep. 26, 1989 |
| 4,875,319 | Hohmann | Oct. 24, 1989 |
| 5,063,722 | Hohmann | Nov. 12, 1991 |
| 5,392,581 | Hatzinikolas et al. | Feb. 28, 1995 |

-continued

| | | |
|---|---|---|
| 5,408,798 | Hohmann | Apr. 25, 1995 |
| 5,456,052 | Anderson et al. | Oct. 10, 1995 |
| 5,816,008 | Hohmann | Oct. 15, 1998 |
| 6,209,281 | Rice | Apr. 03, 2001 |
| 6,279,283 | Hohmann et al. | Aug. 28, 2001 |
| 6,668,505 | Hohmann et al. | Dec. 30, 2003 |
| 7,017,318 | Hohmann, et al. | Mar. 28, 2006 |
| 7,415,803 | Bronner | Aug. 26, 2008 |
| 7,562,506 | Hohmann, Jr. | Jul. 21, 2009 |
| 7,845,137 | Hohmann, Jr. | Dec. 07, 2010 |

| Pat. App. | Inventor | Publication Date |
|---|---|---|
| 2010/0037552 | Bronner | Feb. 18, 2010 |

Foreign Patent Documents

| | | | |
|---|---|---|---|
| 279209 | CH | 52/714 | March 1952 |
| 2069024 | GB | 52/714 | August 1981 |

It is noted that with some exceptions these devices are generally descriptive of wire-to-wire anchors and wall ties and have various cooperative functional relationships with straight wire runs embedded in the inner and/or outer wythe.

U.S. Pat. No. 3,377,764—D. Storch—Issued Apr. 16, 1968 Discloses a bent wire, tie-type anchor for embedment in a facing exterior wythe engaging with a loop attached to a straight wire run in a backup interior wythe.

U.S. Pat. No. 4,021,990—B. J. Schwalberg—Issued May 10, 1977 Discloses a dry wall construction system for anchoring a facing veneer to wallboard/metal stud construction with a pronged sheetmetal anchor. Like Storch '764, the wall tie is embedded in the exterior wythe and is not attached to a straight wire run.

U.S. Pat. No. 4,373,314—J. A. Allan—Issued Feb. 15, 1983 Discloses a vertical angle iron with one leg adapted for attachment to a stud; and the other having elongated slots to accommodate wall ties. Insulation is applied between projecting vertical legs of adjacent angle irons with slots being spaced away from the stud to avoid the insulation.

U.S. Pat. No. 4,473,984—Lopez—Issued Oct. 2, 1984 Discloses a curtain-wall masonry anchor system wherein a wall tie is attached to the inner wythe by a self-tapping screw to a metal stud and to the outer wythe by embedment in a corresponding bed joint. The stud is applied through a hole cut into the insulation.

U.S. Pat. No. 4,869,038—M. J. Catani—Issued Sep. 26, 1989 Discloses a veneer wall anchor system having in the interior wythe a truss-type anchor, similar to Hala et al. '226, supra, but with horizontal sheetmetal extensions. The extensions are interlocked with bent wire pintle-type wall ties that are embedded within the exterior wythe.

U.S. Pat. No. 4,875,319—R. Hohmann—Issued Oct. 24, 1989 Discloses a seismic construction system for anchoring a facing veneer to wallboard/metal stud construction with a pronged sheetmetal anchor. Wall tie is distinguished over that of Schwalberg '990 and is clipped onto a straight wire run.

U.S. Pat. No. 5,392,581—Hatzinikolas et al.—Issued Feb. 28, 1995 Discloses a cavity-wall anchor having a conventional tie wire for mounting in the brick veneer and an L-shaped sheetmetal bracket for mounting vertically between side-by-side blocks and horizontally on atop a course of blocks. The bracket has a slit which is vertically disposed and protrudes into the cavity. The slit provides for a vertically adjustable anchor.

U.S. Pat. No. 5,408,798—Hohmann—Issued Apr. 25, 1995 Discloses a seismic construction system for a cavity wall having a masonry anchor, a wall tie, and a facing anchor.

Sealed eye wires extend into the cavity and wire wall ties are threaded therethrough with the open ends thereof embedded with a Hohmann '319 (see supra) clip in the mortar layer of the brick veneer.

U.S. Pat. No. 5,456,052—Anderson et al.—Issued Oct. 10, 1995 Discloses a two-part masonry brick tie, the first part being designed to be installed in the inner wythe and then, later when the brick veneer is erected to be interconnected by the second part. Both parts are constructed from sheetmetal and are arranged on substantially the same horizontal plane.

U.S. Pat. No. 5,816,008—Hohmann—Issued Oct. 15, 1998 Discloses a brick veneer anchor primarily for use with a cavity wall with a drywall inner wythe. The device combines an L-shaped plate for mounting on the metal stud of the drywall and extending into the cavity with a T-head bent stay. After interengagement with the L-shaped plate the free end of the bent stay is embedded in the corresponding bed joint of the veneer.

U.S. Pat. No. 6,209,281—Rice—Issued Apr. 3, 2001 Discloses a masonry anchor having a conventional tie wire for mounting in the brick veneer and sheetmetal bracket for mounting on the metal-stud-supported drywall. The bracket has a slit which is vertically disposed when the bracket is mounted on the metal stud and, in application, protrudes through the drywall into the cavity. The slit provides for a vertically adjustable anchor.

U.S. Pat. No. 6,279,283—Hohmann et al.—Issued Aug. 28, 2001 Discloses a low-profile wall tie primarily for use in renovation construction where in order to match existing mortar height in the facing wythe a compressed wall tie is embedded in the bed joint of the brick veneer.

U.S. Pat. No. 6,668,505—Hohmann et al.—Issued Dec. 30, 2003 Discloses high span anchors and reinforcements for masonry walls that are combined with interlocking veneer ties which utilize reinforcing wire and wire formatives. The wire formatives are compressively reduced in height by cold-working.

U.S. Pat. No. 7,017,318—Hohmann et al.—Issued Mar. 28, 2006 Discloses a high span anchoring system for cavity wall that incorporates a wall reinforcement combined with a wall tie. The wire formatives utilized are compressively reduced in height by cold-working the metal alloys.

U.S. Pat. No. 7,415,803—Bronner—Issued Aug. 26, 2008 Discloses a wing nut wall anchoring system for use with a two legged wire tie. The wing nut is rotatable in all directions to allow angular adjustment of the wire tie.

U.S. Pat. No. 7,562,506—Hohmann, Jr.—Issued Jul. 21, 2009 Discloses a notched surface-mounted wall anchor and anchoring system for use with various wire formative veneer ties. The notches, upon surface mounting of the anchor, form small wells which entrain fluids and inhibit entry of same into the wallboard.

U.S. Pat. No. 7,845,137—Hohmann, Jr.—Issued Dec. 7, 2010 Discloses a folded wall anchor and anchoring system for use with various wire formative veneer ties. The folded wall anchor enables sheathing of the hardware and sealing of the insertion points.

U.S. Pub. No. 2010/0037552—Bronner—Filed Jun. 1, 2009 Discloses a side-mounted anchoring system for veneer wall tie connection. The system transfers horizontal loads between a backup wall and a veneer wall.

None of the above provide a high-strength, supported surface-mounted wall anchor or anchoring systems utilizing the thermally-isolated wall anchor assembly of this invention. The wall anchor assembly is thermally-isolating and self-sealing through the use of non-conductive washers affixed to the cylinder and the fastener. The wall anchor assembly is modifiable for use on various style wall anchors allowing for interconnection with veneer ties in varied cavity wall structures.

As will become clear in reviewing the disclosure which follows, the cavity wall structures benefit from the recent developments described herein that lead to solving the problems of insulation integrity, thermally conductive anchoring systems, and of high-span applications, and of pin-point loading. The wall anchors, when combined with various veneer tie arrangements hereof, provide for angular adjustment therebetween, self-leveling installation, and seismic level of protection. The prior art does not provide the present novel cavity wall construction system as described herein below.

SUMMARY

In general terms, the invention disclosed hereby is a high-strength thermally-isolating surface-mounted anchoring system for use in a cavity wall structure. The anchoring system is a combination of a wall anchor, a series of seals and a veneer tie. The wall anchor is a stepped cylinder that contains a wallboard step with a first configured open end dimensioned for insertion within the wallboard inner wythe and an insulation step with a second configured open end at the end opposite the first configured open end. The stepped cylinder is affixed to the inner wythe with a fastener that is sheathed by the stepped cylinder and thermally-isolated by a series of seals which include: a wallboard seal disposed at the juncture of the wallboard step and the first configured open end; an insulation seal disposed on the insulation step adjacent the juncture of the insulation step and the second configured open end; and a tubule seal disposed about the fastener at the juncture of the fastener body and the fastener head. The fastener is self-drilling and self-tapping. The tubule assembly seals are compressible sealing washers that preclude the passage of fluids through the inner wythe. The second configured open end is workable for attachment to an anchor base portion.

The anchor base portion is a plate-like structure with an aperture, mounting surface and two wings that extend into the cavity. The wings each contain a veneer tie receptor for attachment to varied veneer ties. The mounting surface precludes penetration of air, moisture and water vapor through the inner wythe. The anchor base optionally contains at least one strengthening rib impressed in the plate-like body that is parallel to the veneer tie receptor. The strengthening rib is constructed to meet a 100 lbf tension and compression rating. The use of this innovative surface-mounted wall anchor in various applications addresses the problems of insulation integrity, pin-point loading, and thermal conductivity.

The anchoring system is disclosed as operating with a variety of veneer ties each providing for different applications. The wire formative veneer ties are either U-shaped or have pintles for interconnection with the veneer tie receptor. The wire formatives are compressively reduced in height by the cold-working thereof and compressively patterned to securely hold to the mortar joint and increase the veneer tie strength. The close control of overall heights permits the mortar of the bed joints to flow over and about the veneer ties. Because the wire formative hereof employ extra strong material and benefit from the cold-working of the metal alloys, the high-span anchoring system meets the unusual requirements demanded. An alternative veneer tie is a T-shaped corrugated sheet metal tie that interlocks with the veneer tie receptor. Reinforcement wires are included to form seismic constructs.

OBJECTS AND FEATURES OF THE INVENTION

It is the object of the present invention to provide a new and novel anchoring system assembly for a cavity wall structure that maintains structural integrity and provides high-strength connectivity and sealing.

It is another object of the present invention to provide an anchoring system for a cavity wall structure having a larger-than-normal cavity, which employs varied low-profile veneer ties.

It is another object of the present invention to provide an anchoring system which is resistive to high levels of tension and compression, precludes pin-point loading, and, further, is detailed to prevent disengagement under seismic or other severe environmental conditions.

It is still yet another object of the present invention to provide an anchoring system which is constructed to maintain insulation integrity by preventing air and water penetration thereinto.

It is a feature of the present invention that the anchor assembly contains components that house a fastener and limit tearing of the insulation upon installation.

It is another feature of the present invention that the anchor assembly utilizes neoprene fittings and has only point contact with the metal studs thereby restricting thermal conductivity.

Other objects and features of the invention will become apparent upon review of the drawings and the detailed description which follows.

BRIEF DESCRIPTION OF THE DRAWING

In the following drawing, the same parts in the various views are afforded the same reference designators.

DESCRIPTION OF THE PREFERRED EMBODIMENTS

Figure 1:
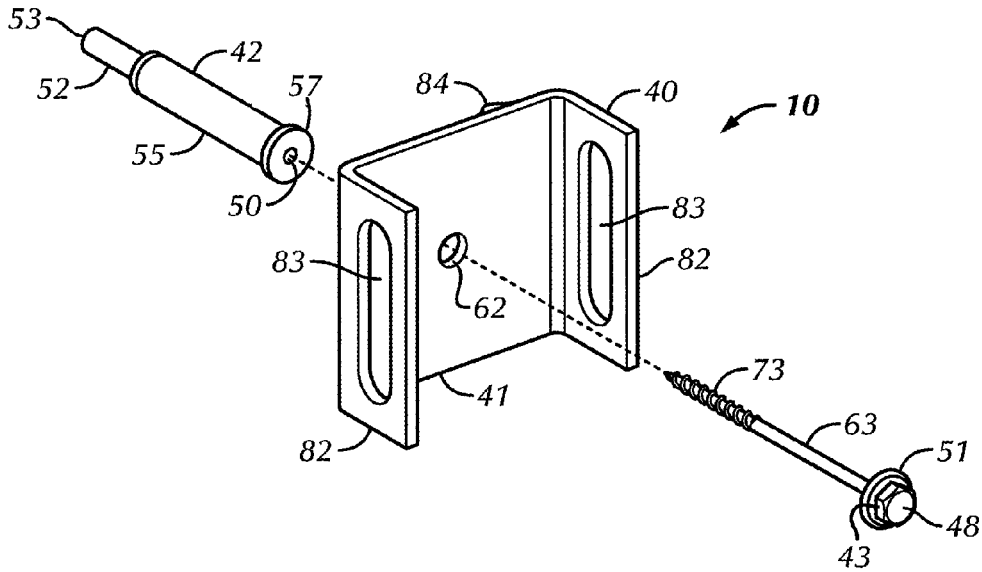
FIG. 1 shows a first embodiment of this invention and is a perspective view of a wall anchor assembly for thermally isolating a surface-mounted wall anchor system in a cavity wall without an associated veneer tie.

Before entering into the detailed Description of the Preferred Embodiments, several terms which will be revisited later are defined. These terms are relevant to discussions of innovations introduced by the improvements of this disclosure that overcome the technical shortcomings of the prior art devices.

In the embodiments described hereinbelow, the inner wythe is provided with insulation. In the dry wall or wallboard construction, this takes the form of exterior insulation disposed on the outer surface of the inner wythe. Recently, building codes have required that after the anchoring system is installed and, prior to the inner wythe being closed up, that an inspection be made for insulation integrity to ensure that the insulation prevents thermal transfer from the exterior to the interior and from the interior to the exterior. Here the term insulation integrity is used in the same sense as the building code in that, after the installation of the anchoring system, there is no change or interference with the insulative properties and concomitantly substantially no change in the air and moisture infiltration characteristics and substantially no loss of heat or air conditioned air from the interior. The present invention is designed to minimize invasiveness into the insulative layer.

For the purposes of this disclosure a cavity wall with a larger-than-normal or high-span cavity is defined as a wall in which the exterior surface of the outer wythe by more than four inches (as measured along a line normal to the surfaces). When such high-span cavities occur, the effect is that stronger joint reinforcements are required in the inner wythe to support the stresses imparted by anchoring the more distant outer wythe or brick veneer. As described herein below, this is accomplished while still maintaining building code requirements for masonry structures, including the mortar bed joint height specification of 0.375 inches. Although thicker gage wire formatives are required for greater strength, it is still preferable to have some of the bed joint mortar covering the wall anchor structure. Thus, in practical terms, the optimal height of the assemblage inserted into the bed joint of the outer wythe is approximately 0.300 inches.

Additionally, in a related sense, prior art sheetmetal anchors have formed a conductive bridge between the wall cavity and the metal studs of columns of the interior of the building. Here the terms thermal conductivity, thermally-isolated and -isolating, and thermal conductivity analysis are used to examine this phenomenon and the metal-to-metal contacts across the inner wythe. The term thermally-isolated stepped cylinder or tubule or tubule or stepped cylinder assembly for thermally isolating a surface-mounted wall anchor as used hereinafter refers to a hollow stepped cylinder having cylindrical portions with differing diameters about a common longitudinal axis and having shoulders between adjacent portions or steps. The hollow stepped cylinder structure facilitates thermal isolation using insulative components at the shoulders thereof and between the head of the fastener and the stepped cylinder opening.

Anchoring systems for cavity walls are used to secure veneer facings to a building and overcome seismic and other forces, i.e. wind shear, etc. In the past some systems have experienced failure because the forces have been concentrated at substantially a single point. Here, the term pin point loading refers to an anchoring system wherein forces are concentrated at a single point. In the Description which follows, means for supporting the wall anchor shaft to limit lateral movement are taught.

In the detailed description, the wall anchor assembly is paired with a variety of interlocking veneer ties. The anchor is secured to the inner wythe through the use of fasteners or mounting hardware.

Figure 2:
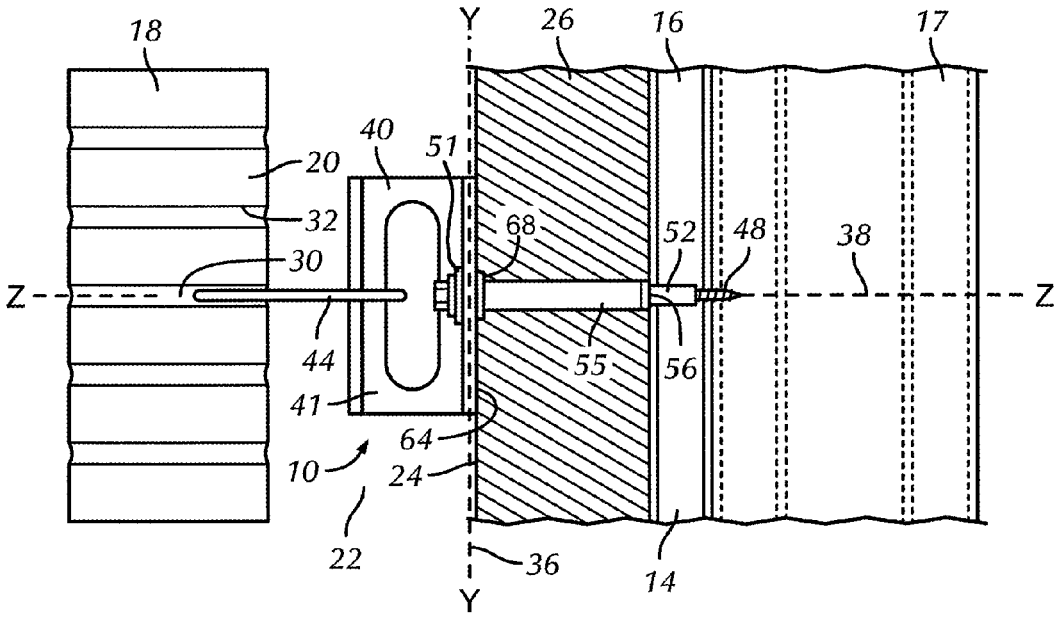
FIG. 2 is a cross sectional view of a surface mounted anchoring system employing the thermally-isolating anchor assembly of FIG. 1 as applied to a cavity wall with an inner wythe of dry wall construction having insulation disposed on the cavity-side thereof and a fastener therethrough and an outer wythe of bricks with the veneer tie embedded therein.
Figure 3:
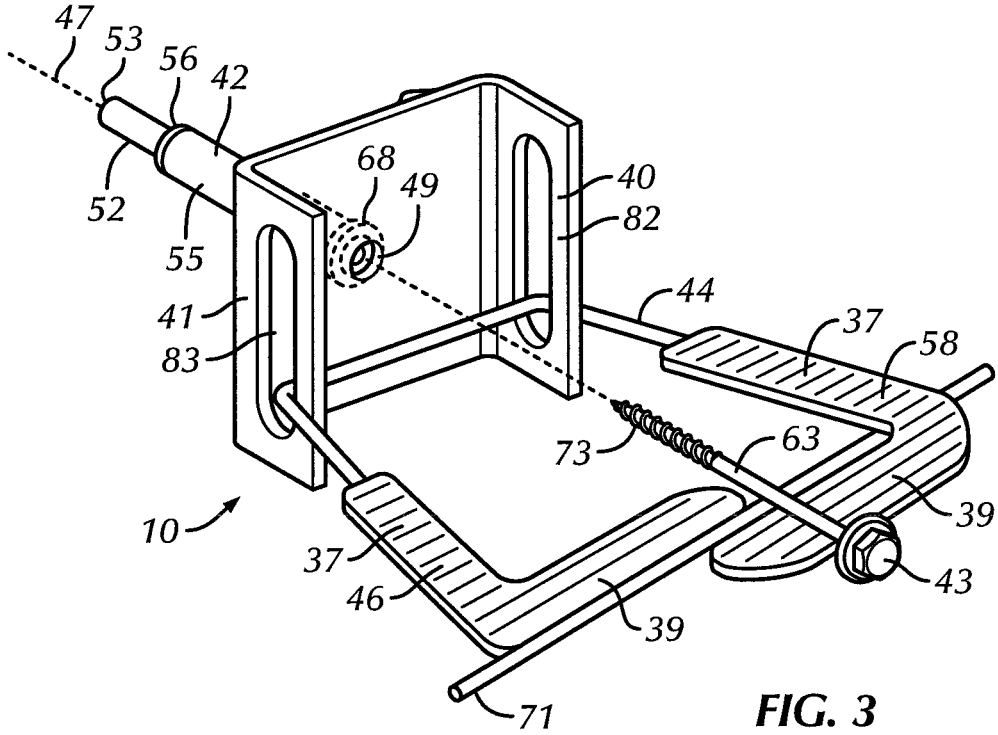
FIG. 3 is a perspective view showing the wall anchor assembly of the thermally-isolating surface-mounted anchoring system for a cavity wall of FIG. 1 with a U-shaped veneer tie with a compressively reduced insertion end and a reinforcement wire interlocked therewith.
Figure 4:
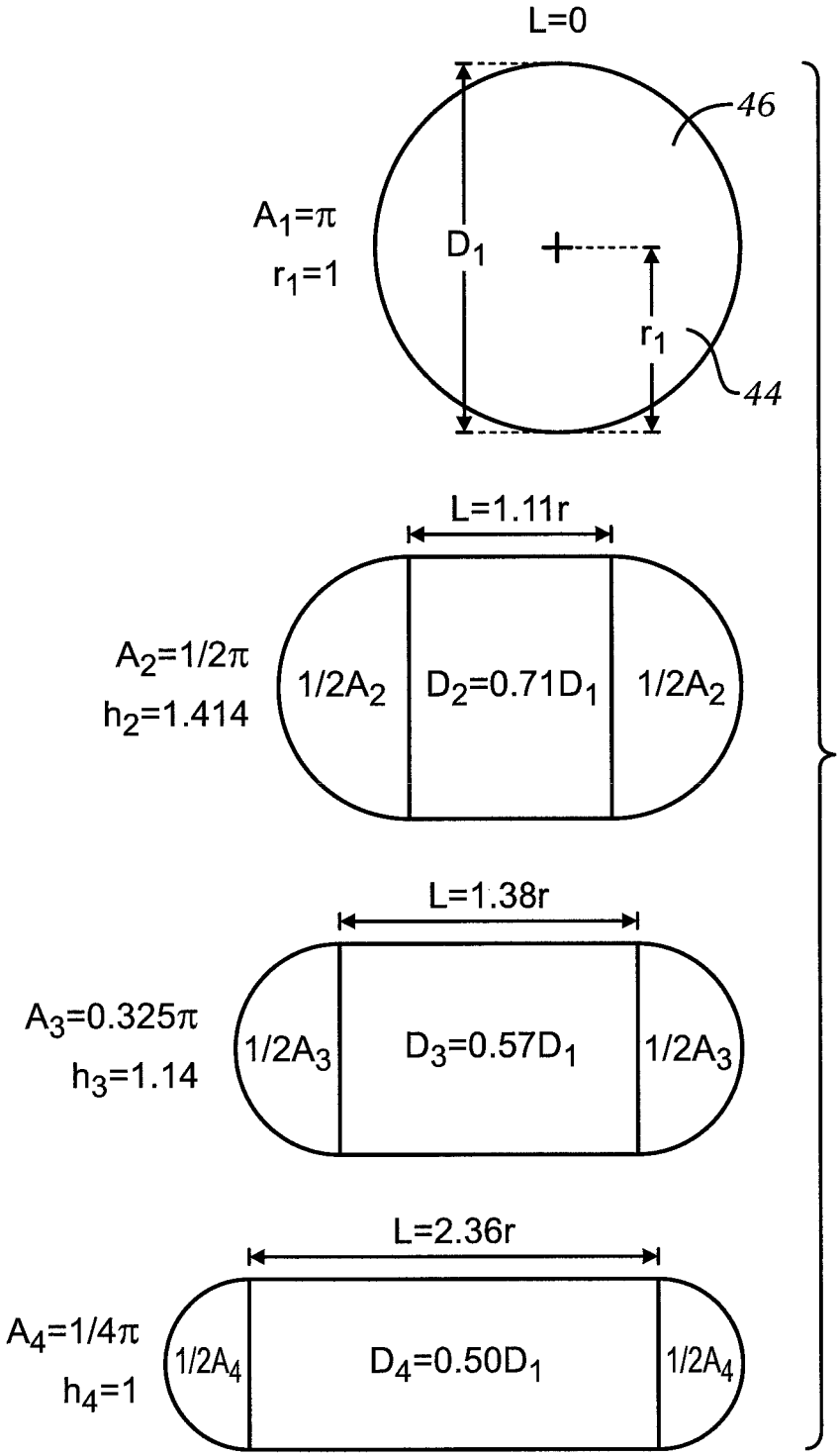
FIG. 4 is a cross-sectional view of the progression of the compressively reduced veneer tie of FIG. 3.

Referring now to FIGS. 1 through 4, the first embodiment shows a surface-mounted, thermally-isolating anchor assembly for a cavity wall. This anchor is suitable for recently promulgated standards with more rigorous tension and compression characteristics. The system discussed in detail hereinbelow, is a high-strength wall anchor for connection with an interengaging veneer tie. The wall anchor is either surface mounted onto an externally insulated dry wall inner wythe (as shown in FIG. 2) or installed onto an externally insulated masonry inner wythe (not shown).

For the first embodiment, a cavity wall having an insulative layer of 3½ inches (approx.) and a total span of 6 inches (approx.) is chosen as exemplary. This structure meets the R-factor requirements of the public sector building specification. The anchoring system is referred to as high-span and generally referred to by the numeral 10. A cavity wall structure having an inner wythe or dry wall backup 14 with sheetrock or wallboard 16 and insulation 26 mounted on metal studs or columns 17 and an outer wythe of facing brick 18 is shown. Between the inner wythe 14 and the outer wythe 18, a cavity 22 is formed. The cavity 22 is larger-than-normal and has a 6-inch span. Successive bed joints 30 and 32 are formed between courses of bricks 20. The bed joints 30 and 32 are substantially planar and horizontally disposed and in accord with building standards are 0.375-inch (approx.) in height.

For purposes of discussion, the cavity surface 24 of the inner wythe 14 contains a horizontal line or x-axis 34 and an intersecting vertical line or y-axis 36. A horizontal line or z-axis 38 also passes through the coordinate origin formed by the intersecting x- and y-axes. A wall anchor 40 which is surface-mounted in anchor-receiving channels 51 in the inner wythe 14, is shown which has an interconnecting veneer tie 44.

The wall anchor 40 has a base portion 41 and a stepped cylinder or stepped cylinder portion 42 with two or more external diameters and contains a wallboard step 52 and an insulation step 55 arrayed about a common longitudinal axis 47. The stepped cylinder 42 has a shaftway or aperture therethrough 50 to sheath a fastener 48 and is optionally affixed to the anchor base 40, which is a stamped metal construct constructed from a plate-like body for surface mounting on inner wythe 14, and for interconnection with a veneer tie 44 and optionally a reinforcement wire 71 for seismic protection.

The stepped cylinder 42 is a cylindrical metal leg constructed from sheet metal such as hot dipped galvanized, stainless and bright basic steel and contains a wallboard step 52 having a first configured open end 53 at the end opposite the first configured open end 53 of the wallboard step 52 and dimensioned to be inserted within the wallboard 16, and an insulation step 55 having a second configured open end 57 that is workable for optional attachment to the anchor base 40 at the base portion aperture 62. The anchor 40 is positioned substantially at right angles (normal) to the longitudinal axis 47 of the stepped cylinder 42 and, when affixed to the anchor base portion 41, where at the location that the stepped cylinder 42 joins to the base 40, the stepped cylinder 42 surrounds the latitudinal (cross-sectional) perimeter of the base portion aperture 62 with some area of stepped cylinder 42 material, through a welding, compression or similar process, extending on all sides of this joint 49 forming a press-fit relationship and a high-strength bond.

An aperture 50 runs the length of the stepped cylinder 42 allowing for the insertion and sheathing of the fastener 48. The cylinder 42 contains a wallboard step 52 with a first configured open end 53 which is optimally located, when inserted within the outer wythe 14, at the intersection 54 of the dry wall 16 and the insulation 26 to provide a seal at such intersection 54. A thermally-isolating wallboard seal 56 is disposed on stepped cylinder 42 at the juncture of the wallboard step 52 and the first configured open end 53 to minimize thermal transfer between the inner wythe 14 and the anchor 10.

At intervals along the inner wythe surface 14, the stepped cylinders 42 are surface-mounted using mounting hardware such as fasteners or self-tapping or self-drilling screws 48 inserted through the stepped cylinders 42. In this structure, the stepped cylinders 42 sheath the exterior of mounting hardware 48. The fasteners 48 are thermally-isolated from the anchor 40 through the use of a series of thermally-isolating washers (wallboard seal 56, insulation seal 68 and stepped cylinder seal 51) composed of compressible nonconductive material such as neoprene. An insulation seal 68 is disposed on the insulation step 55 adjacent to the juncture of the insulation step 55 and the second configured open end 57. The tubule or stepped cylinder seal 51 is disposed about the fastener at the juncture of the fastener body 63 and the fastener head 43 and seals the shaftway 50 and the anchor base portion aperture 62. The fastener head 43 has a larger circumference than the base portion aperture 62 to ensure that the fastener 48 will not be displaced within the aperture 62. The head 43 is adjacent a fastener body 63 which is sheathed by the stepped cylinder 42 upon insertion to limit insulation 26 tearing. Opposite the fastener head 43 is a self-tapping or self-drilling tip 73 which is affixed to the inner wythe 14 upon installation.

Upon insertion of the stepped cylinder 42 into the layers of the inner wythe 14, the anchor base portion 41 rests snugly against the opening formed by the insertion of the stepped cylinder 42 and serves to provide further sealing of the stepped cylinder 42 insertion opening in the insulation 26 precluding the passage of air and moisture therethrough. This construct maintains the insulation integrity.

The plate-like anchor base portion or base portion 41 has an aperture 62, mounting surface 64 facing the inner wythe 14 and adjacent the stepped cylinder 42, and two wings 82 that extend into the cavity 22 substantially normal to the base portion 41. The wings 82 each have a veneer tie receptor 83 and face towards the outer wythe 18. The mounting surface 64 precludes the penetration of air, moisture and water vapor through the inner wythe 14.

The dimensional relationship between the wall anchor 40 and veneer tie 44 limits the axial movement of the construct. The veneer tie receptor 83 is constructed, in accordance with the building code requirements, to be within the predetermined dimensions to limit movement of the interlocking veneer tie 44. The veneer tie receptor 83 is slightly larger horizontally than the diameter of the tie 44. The veneer tie receptor 83 is designed to accept a veneer tie 44 threadedly therethrough and limit horizontal and vertical movement.

In this embodiment, as best seen in FIG. 1, optional strengthening ribs 84 are impressed in the mounting surface 64. The ribs 84 are substantially parallel to the veneer tie receptor 83 and, when mounting hardware 48 is fully seated so that the mounting surface 64 rests against the face of insulation 26, the ribs 84 are then pressed into the surface of the insulation 26. This provides additional sealing. While the ribs 84 are shown as protruding toward the insulation, it is within the contemplation of this invention that the ribs 84 could be raised in the opposite direction. The alternative structure would be used in applications wherein the outer layer of the inner wythe is noncompressible and does not conform to the rib contour. The ribs 84 strengthen the assembly 10 and achieves an anchor with a tension and compression rating of 100 lbf. Further sealing is obtained through the use of a sealant (not shown) between the mounting surface 64 and the exterior layer of the inner wythe 14.

The veneer tie 44 is a wire formative dimensioned for embedment in the bed joint 30 of the outer wythe 18. For high-span applications, the wire formatives have been strengthened in several ways. A 0.250-inch wire is used to form the veneer tie 44. To approximate the 0.300-inch optimal height, the insertion end 46 of the veneer tie 44 is compressed. As a general rule, compressive reductions up to 75% are utilized and high-span strength calculations are based thereon.

The veneer tie 44 is, when viewed from a top or bottom elevation, generally U-shaped. The insertion end 46, upon installation extends beyond the cavity 22 into bed joint 30, which portion includes front leg portions 39 and side leg portions 37. The front leg portions 39 are offset the one to the other and contain an indentation or compression 78 that enables the veneer reinforcing wire 71 to interlock with the veneer tie 44 within the 0/300-inch tolerance thereby forming a seismic construct.

Analytically, wall anchor calculations entail viewing a weight hanging from the end of a beam. Here, the circular cross-section of a wire provides greater flexural strength than a sheet metal counterpart. In the embodiments described herein the wire components of the veneer tie 44 are cold-worked or partially flattened so that the above-referenced height specification is maintained and high-strength anchors are provided for the high-span cavities. It has been found that, when the appropriate metal alloy is cold-worked, the desired plastic deformation takes place with a concomitant increase in tensile strength and a decrease in ductility. These property changes suit the application at hand. In deforming a wire with a circular cross-section, the cross-section of the resultant body is substantially semicircular at the outer edges with a rectangular body therebetween, FIG. 4. The deformed body has substantially the same cross-sectional area as the original wire. Therefore, disregarding elongation, if a wire of a given radius is flattened to 75% of the original diameter, it is found that:

$$A_o=\pi r^2,$$

where $A_o$=cross-sectional area of original wire
R=radius $$A_D=\tfrac{1}{4}\pi r^2+rx,$$

where $A_D$=cross-sectional area of deformed wire
x=length of flattened portion $$x=\tfrac{3}{4}\pi r^2=2.36r$$

From these estimation formulas, the degree of plastic deformation to remain at a 0.300 inch (approx.) height for the veneer tie 44 can, as will be seen herein below, be used to optimize the high-span anchoring system.

The insertion end 46 of the facing veneer tie 44 is a wire formative formed from a wire having a diameter substantially equal to the predetermined height of the mortar joint. Upon compressible reduction in height, the insertion end 46 is mounted upon the exterior wythe positioned to receive mortar thereabout. The insertion end 46 retains the mass and substantially the tensile strength as prior to deformation. The vertical height of the insertion end 46 is reduced so that, upon installation, mortar of bed joint 30 flows around the insertion end 46. Upon compression, a pattern or corrugation 58 is impressed on insertion end 46 and, upon the mortar of bed joint 30 flowing around the insertion end 46, the mortar flows into the corrugation 58. For enhanced holding, the corrugations 58 are, upon installation, substantially parallel to x-axis 34. In this embodiment, the pattern 48 is shown impressed on only one side thereof; however, it is within the contemplation of this disclosure that corrugations or other patterning could be impressed on other surfaces of the insertion end 46. Other patterns such as a waffle-like, cellular structure and similar structures optionally replace the corrugations. With the veneer tie 44 constructed as described, the veneer tie 44 is characterized by maintaining substantially all the tensile strength as prior to compression while acquiring a desired low profile.

Figure 5:
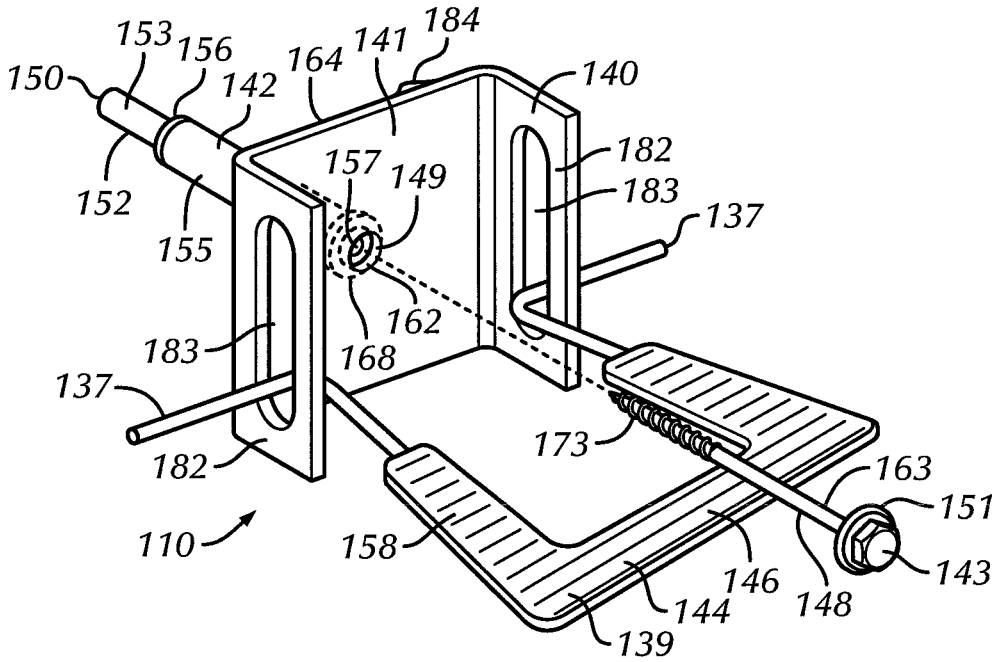
FIG. 5 is a perspective view of a second embodiment of this invention showing an anchor assembly for a thermally-isolated wall anchoring system with the associated fastener and an interlocked compressively reduced veneer tie.

The description which follows is a second embodiment of thermally-isolating anchoring system for cavity walls of this invention. For ease of comprehension, wherever possible similar parts use reference designators 100 units higher than those above. Thus, the stepped cylinder 142 of the second embodiment is analogous to the stepped cylinder 42 of the first embodiment. Referring now to FIG. 5, the second embodiment is shown and is referred to generally by the numeral 110. As in the first embodiment, a wall structure similar to that shown in FIG. 2 is used herein. Optionally, a masonry inner wythe is used.

FIG. 5 shows a surface-mounted, thermally-isolating anchor assembly for a cavity wall. This anchor is suitable for recently promulgated standards with more rigorous tension and compression characteristics. The system discussed in detail hereinbelow, is a high-strength wall anchor for connection with an interengaging veneer tie. The wall anchor is either surface mounted onto an externally insulated dry wall inner wythe (as shown in FIG. 2) or installed onto an externally insulated masonry inner wythe (not shown).

As in the first embodiment, as shown in FIG. 2, a cavity wall having an insulative layer of 3½ inches (approx.) and a total span of 6 inches (approx.) is chosen as exemplary. This structure meets the R-factor requirements of the public sector building specification. The anchoring system is referred to as high-span and generally referred to by the numeral 110. A cavity wall structure having an inner wythe or dry wall backup 14 with sheetrock or wallboard 16 and insulation 26 mounted on metal studs or columns 17 and an outer wythe of facing brick 18 is shown. Between the inner wythe 14 and the outer wythe 18, a cavity 22 is formed. The cavity 22 is larger-than-normal and has a 6-inch span. Successive bed joints 30 and 32 are formed between courses of bricks 20. The bed joints 30 and 32 are substantially planar and horizontally disposed and in accord with building standards are 0.375-inch (approx.) in height.

For purposes of discussion, the cavity surface 24 of the inner wythe 14 contains a horizontal line or x-axis 34 and an intersecting vertical line or y-axis 36. A horizontal line or z-axis 38 also passes through the coordinate origin formed by the intersecting x- and y-axes. A wall anchor 40 which is surface-mounted in anchor-receiving channels 51 in the inner wythe 14, is shown which has an interconnecting veneer tie 44.

The wall anchor 140 has a base portion 141 and a stepped cylinder or stepped cylinder portion 142 with two or more external diameters and contains a wallboard step 152 and an insulation step 155 arrayed about a common longitudinal axis 147. The stepped cylinder 142 has a shaftway or aperture therethrough 150 to sheath a fastener 148 and is optionally affixed to the anchor base 140, which is a stamped metal construct constructed from a plate-like body for surface mounting on inner wythe 14, and for interconnection with a veneer tie 144.

The stepped cylinder 142 is a cylindrical metal leg constructed from sheet metal such as hot dipped galvanized, stainless and bright basic steel and contains a wallboard step 152 having a first configured open end 153 at the end opposite the first configured open end 153 of the wallboard step 152 and dimensioned to be inserted within the wallboard 16 and an insulation step 155 having a second configured open end 157 that is workable for optional attachment to the anchor base 140 at the base portion aperture 162. The anchor 140 is positioned substantially at right angles (normal) to the longitudinal axis 147 of the stepped cylinder 142 and, when affixed to the anchor base portion 141, where at the location that the stepped cylinder 142 joins to the base 140, the stepped cylinder 142 surrounds the latitudinal (cross-sectional) perimeter of the base portion aperture 162 with some area of stepped cylinder 142 material, through a welding, compression or similar process, extending on all sides of this joint 149, forming a press-fit relationship and a high-strength bond.

An aperture 150 runs the length of the stepped cylinder 142 allowing for the insertion and sheathing of the fastener 148. The cylinder 142 contains a wallboard step 152 with a first configured open end 153 which is optimally located, when inserted within the outer wythe 14, at the intersection 54 of the dry wall 16 and the insulation 26 to provide a seal at such intersection 54. A thermally-isolating wallboard seal 156 is disposed on stepped cylinder 142 at the juncture of the wallboard step 152 and the first configured open end 153 to minimize thermal transfer between the inner wythe 14 and the anchor 40.

At intervals along the inner wythe surface 14, the stepped cylinders 142 are surface-mounted using mounting hardware such as fasteners or self-tapping or self-drilling screws 148 inserted through the stepped cylinders 142. In this structure, the stepped cylinders 142 sheath the exterior of mounting hardware 148. The fasteners 148 are thermally-isolated from the anchor 140 through the use of a series of thermally-isolating washers (wallboard seal 156, insulation seal 168 and stepped cylinder seal 151) composed of compressible non-conductive material such as neoprene. An insulation seal 168 is disposed on the insulation step 155 adjacent to the juncture of the insulation step 155 and the second configured open end 157. The stepped cylinder or tubule seal 151 is disposed about the fastener at the juncture of the fastener body 163 and the fastener head 143 and seals the shaftway 150 and the anchor base portion aperture 162. The fastener head 143 has a larger circumference than the base portion aperture 162 to ensure that the fastener 148 will not be displaced within the aperture 162. The head 143 is adjacent a fastener body 163 which is sheathed by the stepped cylinder 142 upon insertion to limit insulation 26 tearing. Opposite the fastener head 143 is a self-tapping or self-drilling tip 173 which is affixed to the inner wythe 14 upon installation.

Upon insertion of the stepped cylinder 142 into the layers of the inner wythe 14, the anchor base portion 141 rests snugly against the opening formed by the insertion of the stepped cylinder 142 and serves to provide further sealing of the stepped cylinder 142 insertion opening in the insulation 26 precluding the passage of air and moisture therethrough. This construct maintains the insulation integrity.

The plate-like anchor base portion or base portion 141 has an aperture 162, mounting surface 164 facing the inner wythe 14 and adjacent the stepped cylinder 142 and two wings 182 that extend into the cavity 22 substantially normal to the base portion 141. The wings 182 each have a veneer tie receptor 183 and face towards the outer wythe 18. The mounting surface 264 precludes the penetration of air, moisture and water vapor through the inner wythe 14.

The dimensional relationship between wall anchor 140 and veneer tie 144 limits the axial movement of the construct. The veneer tie receptor 183 is constructed, in accordance with the building code requirements, to be within the predetermined dimensions to limit movement of the interlocking veneer tie 144. The veneer tie receptor 183 is slightly larger horizontally than the diameter of the tie 144. The veneer tie receptor 183 is designed to accept a veneer tie 144 threadedly therethrough and limit horizontal and vertical movement.

In this embodiment, optional strengthening ribs 184 are impressed in the mounting surface 164. The ribs 184 are substantially parallel to the veneer tie receptor 183 and, when mounting hardware 148 is fully seated so that the mounting surface 264 rests against the face of insulation 26, the ribs 184 are then pressed into the surface of the insulation 26. This provides additional sealing. While the ribs 184 are shown as protruding toward the insulation, it is within the contemplation of this invention that ribs 184 could be raised in the opposite direction. The alternative structure would be used in applications wherein the outer layer of the inner wythe is noncompressible and does not conform to the rib contour. The ribs 184 strengthen the assembly 110 and achieves an anchor with a tension and compression rating of 100 lbf. Further sealing is obtained through the use of a sealant (not shown) between the mounting surface 164 and the exterior layer of the inner wythe 14.

The veneer tie 144 is a wire formative dimensioned for embedment in the bed joint 30 of the outer wythe 18. As discussed in the first embodiment and further described in FIG. 4, the insertion end 146 is, upon cold-forming, optionally impressed with a pattern on the mortar-contacting surfaces 148. The insertion end 146, upon installation extends beyond the cavity 22 into bed joint 30, which portion includes front leg portion 139 and side leg portions 137. The side leg portions are pintles 137 and are inserted, by twisting or compressing the side leg portions 137, into the veneer tie receptors 183 to interlock within the wall anchor 140 and prevent the veneer tie 144 displacement.

The insertion end 146 of the veneer tie 144 is a wire formative formed from a wire having a diameter substantially equal to the predetermined height of the mortar joint. Upon compressible reduction in height, the insertion end 146 is mounted upon the exterior wythe positioned to receive mortar thereabout. The insertion end 146 retains the mass and substantially the tensile strength as prior to deformation. The vertical height of the insertion end 146 is reduced so, that, upon installation, mortar of bed joint 30 flows around the insertion end 146. Upon compression, a pattern or corrugation 158 is impressed on insertion end 146 and, upon the mortar of bed joint 30 flowing around the insertion end 146, the mortar flows into the corrugation 158. For enhanced holding, the corrugations 158 are, upon installation, substantially parallel to x-axis 34. In this embodiment, the pattern 158 is shown impressed on only one side thereof; however, it is within the contemplation of this disclosure that corrugations or other patterning could be impressed on other surfaces of the insertion end 146. Other patterns such as a waffle-like, cellular structure and similar optionally replace the corrugations. With the veneer tie 144 constructed as described, the veneer tie 144 is characterized by maintaining substantially all the tensile strength as prior to compression while acquiring a desired low profile.

Figure 6:
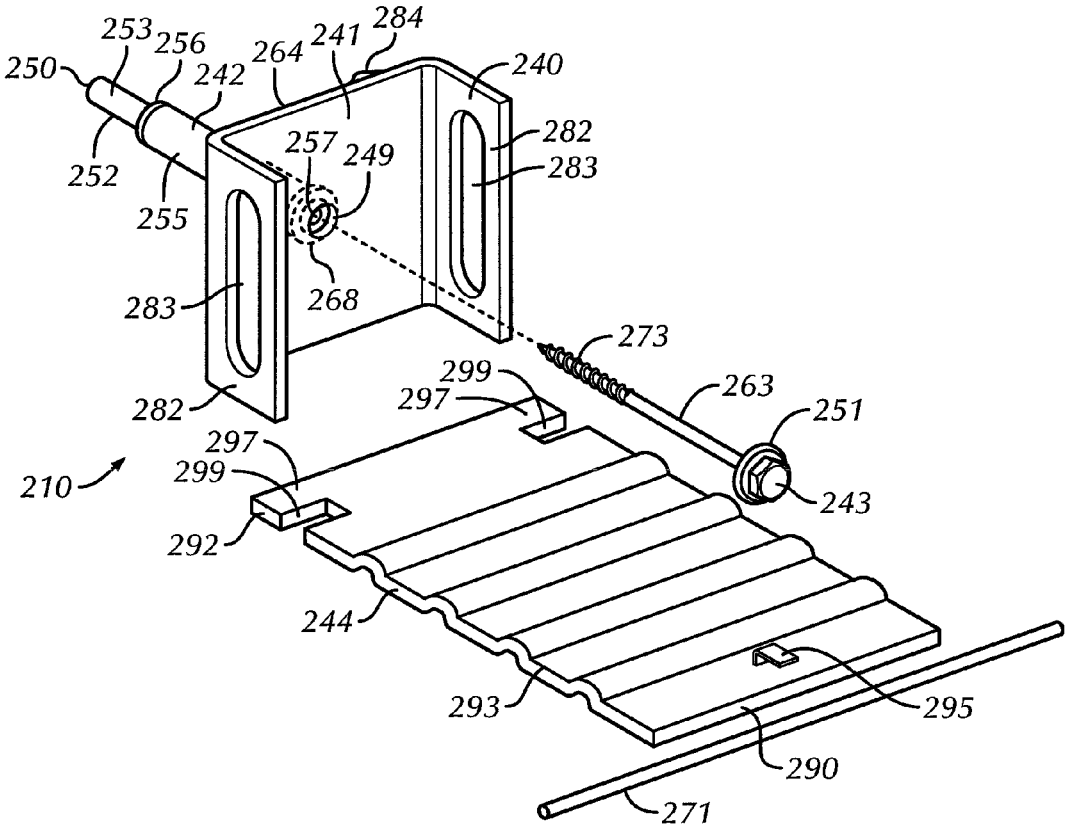
FIG. 6 is a perspective view of a third embodiment of this invention showing an anchor assembly for a thermally-isolated wall anchoring system with the associated fastener and a corrugated sheet metal veneer tie.

The description which follows is a third embodiment of thermally-isolating anchoring system for cavity walls of this invention. For ease of comprehension, wherever possible similar parts use reference designators 200 units higher than those above. Thus, the stepped cylinder 142 of the second embodiment is analogous to the stepped cylinder 242 of the third embodiment. Referring now to FIG. 6, the third embodiment is shown and is referred to generally by the numeral 210.

As in the first embodiment, a wall structure similar to that shown in FIG. 2 is used herein. Optionally, a masonry inner wythe is used.

FIG. 6 shows a surface-mounted, thermally-isolating anchor assembly for a cavity wall. This anchor is suitable for recently promulgated standards with more rigorous tension and compression characteristics. The system discussed in detail hereinbelow, is a high-strength wall anchor for connection with an interengaging veneer tie. The wall anchor is either surface mounted onto an externally insulated dry wall inner wythe (as shown in FIG. 2) or installed onto an externally insulated masonry inner wythe (not shown). As in the first embodiment, as shown in FIG. 2, a cavity wall having dry wall and insulation mounted on metal studs or columns is chosen as exemplary.

The anchoring system is generally referred to as to by the numeral 210. A cavity wall structure having an inner wythe or dry wall backup 14 with sheetrock or wallboard 16 and insulation 26 mounted on metal studs or columns 17 and an outer wythe of facing brick 18 is shown. Between the inner wythe 14 and the outer wythe 18, a cavity 22 is formed. Successive bed joints 30 and 32 are formed between courses of bricks 20. The bed joints 30 and 32 are substantially planar and horizontally disposed and in accord with building standards are 0.375-inch (approx.) in height.

For purposes of discussion, the cavity surface 24 of the inner wythe 14 contains a horizontal line or x-axis 34 and an intersecting vertical line or y-axis 36. A horizontal line or z-axis 38 also passes through the coordinate origin formed by the intersecting x- and y-axes. A wall anchor 40 which is surface-mounted in anchor-receiving channels 51 in the inner wythe 14, is shown which has an interconnecting veneer tie 244.

The wall anchor 240 has a base portion 241 and a stepped cylinder or stepped cylinder portion 242 with two or more external diameters and contains a wallboard step 252 and an insulation step 255 arrayed about a common longitudinal axis 247. The stepped cylinder 242 has a shaftway or aperture therethrough 250 to sheath a fastener 248 and is optionally affixed to the anchor base 240, which is a stamped metal construct constructed from a plate-like body for surface mounting on inner wythe 14, and for interconnection with a veneer tie 244.

The stepped cylinder 242 is a cylindrical metal leg constructed from sheet metal such as hot dipped galvanized, stainless and bright basic steel and contains a wallboard step 252 having a first configured open end 253 at the end opposite the first configured open end 253 of the wallboard step 252 and dimensioned to be inserted within the wallboard 16, and an insulation step 255 having a second configured open end 257 that is workable for optional attachment to the anchor base 240 at the base portion aperture 262. The anchor 240 is positioned substantially at right angles (normal) to the longitudinal axis 247 of the stepped cylinder 242 and, when affixed to the anchor base portion 241, where at the location that the stepped cylinder 242 joins to the base 240, the stepped cylinder 242 surrounds the latitudinal (cross-sectional) perimeter of the base portion aperture 262 with some area of stepped cylinder 242 material, through a welding, compression or similar process, extending on all sides of this joint 249 forming a press-fit relationship and a high-strength bond.

An aperture 250 runs the length of the stepped cylinder 242 allowing for the insertion and sheathing of the fastener 248. The cylinder 242 contains a wallboard step 252 with a first configured open end 253 which is optimally located, when inserted within the outer wythe 14, at the intersection 54 of the dry wall 16 and the insulation 26 to provide a seal at such intersection 54. A thermally-isolating wallboard seal 256 is disposed on stepped cylinder 242 at the juncture of the wallboard step 252 and the first configured open end 253 to minimize thermal transfer between the inner wythe 14 and the anchor 40.

At intervals along the inner wythe surface 14, the stepped cylinders 242 are surface-mounted using mounting hardware such as fasteners or self-tapping or self-drilling screws 248 inserted through the stepped cylinders 242. In this structure, the stepped cylinders 242 sheath the exterior of mounting hardware 248. The fasteners 248 are thermally-isolated from the anchor 240 through the use of a series of thermally-isolating washers (wallboard seal 256, insulation seal 268 and stepped cylinder seal 251) composed of compressible non-conductive material such as neoprene. An insulation seal 268 is disposed on the insulation step 255 adjacent to the juncture of the insulation step 255 and the second configured open end 257. The stepped cylinder or tubule seal 251 is disposed about the fastener at the juncture of the fastener body 263 and the fastener head 243 and seals the shaftway 250 and the anchor base portion aperture 262. The fastener head 243 has a larger circumference than the base portion aperture 262 to ensure that the fastener 248 will not be displaced within the aperture 262. The head 243 is adjacent a fastener body 263 which is sheathed by the stepped cylinder 242 upon insertion to limit insulation 26 tearing. Opposite the fastener head 243 is a self-tapping or self-drilling tip 273 which is affixed to the inner wythe 14 upon installation.

Upon insertion of the stepped cylinder 242 into the layers of the inner wythe 14, the anchor base portion 241 rests snugly against the opening formed by the insertion of the stepped cylinder 242 and serves to provide further sealing of the stepped cylinder 242 insertion opening in the insulation 26 precluding the passage of air and moisture therethrough. This construct maintains the insulation integrity.

The plate-like anchor base portion or base portion 241 has an aperture 262, mounting surface 264 facing the inner wythe 14 and adjacent the stepped cylinder 242 and two wings 282 that extend into the cavity 22 substantially normal to the base portion 241. The wings 282 each have a veneer tie receptor 283 and face towards the outer wythe 18. The mounting surface 264 precludes the penetration of air, moisture and water vapor through the inner wythe 14.

The dimensional relationship between wall anchor 240 and veneer tie 244 limits the axial movement of the construct. The veneer tie receptor 283 is constructed, in accordance with the building code requirements, to be within the predetermined dimensions to limit movement of the interlocking veneer tie 244. The veneer tie receptor 283 is slightly larger horizontally than the diameter of the tie 244. The veneer tie receptor 283 is designed to accept a veneer tie 244 threadedly therethrough and limit horizontal and vertical movement.

Optional strengthening ribs 284 are impressed in the mounting surface 264. The ribs 284 are substantially parallel to the veneer tie receptor 283 and, when mounting hardware 248 is fully seated so that the mounting surface 264 rests against the face of insulation 26, the ribs 284 are then pressed into the surface of the insulation 26. This provides additional sealing. While the ribs 284 are shown as protruding toward the insulation, it is within the contemplation of this invention that ribs 284 could be raised in the opposite direction. The alternative structure would be used in applications wherein the outer layer of the inner wythe is noncompressible and does not conform to the rib contour. The ribs 284 strengthen the assembly 210 and achieves an anchor with a tension and compression rating of 100 lbf. Further sealing is obtained through the use of a sealant (not shown) between the mounting surface 264 and the exterior layer of the inner wythe 14.

The veneer tie 244 is formed from sheet metal and dimensioned for embedment in the bed joint 30 of the outer wythe 18. The veneer tie has an insertion end 290 and a T-shaped attachment end 292. For this application, while several patterns—corrugated, diamond and cellular—are discussed herein, only the corrugated pattern 293 on the insertion end 290 is employed. The corrugations enable the veneer tie 244 to securely hold to the mortar joint and increase the veneer tie 244 strength. The insertion end 246, upon installation extends beyond the cavity 22 into bed joint 30. The insertion end 290 optionally contains a notch 295 to interlock with a reinforcement wire 271 to form a seismic construct. The attachment end 292 contains two indentations 299 for twisted insertion within the veneer tie receptors 283 and T-edges 297 that upon insertion within the veneer tie receptors interlock with the wall anchor 240 and prevent the veneer tie 244 displacement.

In the above description of the thermally-isolating anchoring system of this invention sets forth various described configurations and applications thereof in corresponding anchoring systems. Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

The thermally-isolating anchoring system of this invention is a new and novel invention which improves on the prior art anchoring systems. The anchoring system is adaptable to varied anchor structures for use with interlocking veneer ties and reinforcement wires to provide a high-strength, high-span surface mounted anchoring system for cavity walls. The anchoring system sheaths the mounting hardware to limit insulation tearing and resultant loss of insulation integrity and disrupts thermal conductivity between the anchoring system and the inner wythe.

What is claimed is:

1. A high-strength thermally-isolating anchoring system for use in a cavity wall, said cavity wall having a wallboard inner wythe and insulation thereon, anchor-receiving channels therethrough, and an outer wythe formed from a plurality of successive courses with a bed joint between each two adjacent courses, said inner wythe and said outer wythe in a spaced apart relationship the one with the other forming a cavity therebetween, said anchoring system comprising, in combination:

a wall anchor adapted for attachment to said inner wythe, said wall anchor further comprising:

a stepped cylinder portion with the steps thereof arrayed about a common longitudinal axis having two or more external diameters dimensioned for a press fit relationship with and for disposition in said anchor-receiving channels, said stepped cylinder having a shaftway therethrough to sheath a fastener; and a base portion having an aperture, a mounting surface adjacent said stepped cylinder portion, said mounting surface precluding penetration of air, moisture and water vapor through said inner wythe, and two wings extending substantially normal to said base portion, said two wings each having a veneer tie receptor;

a fastener configured for disposition in said aperture of said base portion and for disposition in said shaftway of said stepped cylinder portion to attach said wall anchor to said inner wythe;

a stepped cylinder seal disposed about said fastener at the juncture of said fastener and said aperture of said base portion; and a veneer tie interlockingly connected with said veneer tie receptor and dimensioned for embedment in said bed joint of said outer wythe.

2. A high-strength thermally-isolating anchoring system as described in claim 1, wherein said stepped cylinder portion further comprises:

a wallboard step having a first configured open end, said wallboard step dimensioned for insertion within said wallboard;

an insulation step adjacent said wallboard step, said insulation step having a second configured open end at the end opposite said first configured open end of said wallboard step, said second configured open end workable for attachment to said anchor base;

a wallboard seal disposed on said stepped cylinder at the juncture of said wallboard step and said first configured open end; and an insulation seal disposed on said insulation step adjacent the juncture of said insulation step and said second configured open end.

3. A high-strength thermally-isolating anchoring system as described in claim 2, wherein said insulation seal, said wallboard seal and said stepped cylinder seal are thermally isolating and constructed of compressible nonconductive material.

4. A high-strength thermally-isolating anchoring system as described in claim 3, wherein said anchor base portion is a plate-like body having at least one strengthening rib impressed therein and parallel to said wings, said at least one strengthening rib constructed to meet a 100 lbf tension and compression rating.

5. A high-strength thermally-isolating anchoring system as described in claim 4, wherein said fastener further comprises:

a fastener head;

a fastener shaft adjacent said head; and a fastener tip adjacent said shaft and opposite said head.

6. A high-strength thermally-isolating anchoring system as described in claim 5, wherein said fastener tip is self-drilling.

7. A high-strength thermally-isolating anchoring system as described in claim 2, wherein said wall anchor base being a single construct formed from sheet metal selected from the group consisting of hot dipped galvanized, stainless steel, and bright basic steel.

8. A high-strength thermally-isolating anchoring system for use in a cavity wall, said cavity wall having a wallboard inner wythe and insulation thereon, anchor-receiving channels therethrough, and an outer wythe formed from a plurality of successive courses with a bed joint between each two adjacent courses, said inner wythe and said outer wythe in a spaced apart relationship the one with the other forming a cavity therebetween, said anchoring system comprising, in combination:

a wall anchor being a single construct and adapted for attachment to said inner wythe, said wall anchor further comprising:

a stepped cylinder portion with the steps thereof arrayed about a common longitudinal axis having two or more external diameters dimensioned for a press fit relationship with and for disposition in said anchor-receiving channel, said stepped cylinder having a shaftway therethrough to sheath a fastener; and a base portion having an aperture, a mounting surface adjacent said stepped cylinder portion, said mounting surface precluding penetration of air, moisture and water vapor through said inner wythe, and two wings extending substantially normal to said base portion, said two wings each having a veneer tie receptor;

a fastener configured for disposition in said shaftway of said stepped cylinder portion to attach said wall anchor to said inner wythe, said fastener further comprising:

a fastener head;

a fastener shaft adjacent said fastener head; and a fastener tip adjacent said body and opposite said fastener head;

a stepped cylinder seal disposed about said fastener at the juncture of said fastener shaft and said fastener head, said stepped cylinder seal being a thermally-isolating neoprene fitting; and a wire formative veneer tie having an insertion end dimensioned for embedment in said bed joint of said outer wythe and an attachment end interlockingly connected with said veneer tie receptor.

9. A high-strength thermally-isolating anchoring system as described in claim 8, wherein said stepped cylinder portion further comprises:

a wallboard step having a first configured open end, said wallboard step dimensioned for insertion within said wallboard;

an insulation step adjacent said wallboard step, said insulation step having a second configured open end at the end opposite said first configured open end of said wallboard step, said second configured open end workable for attachment to said anchor base;

a wallboard seal disposed on said stepped cylinder at the juncture of said wallboard step and said first configured open end, said wallboard seal being a stabilizing thermally-isolating neoprene fitting; and an insulation seal disposed on said insulation step adjacent the juncture of said insulation step and said second configured open end, said insulation seal being a stabilizing thermally-isolating neoprene fitting.

10. A high-strength thermally-isolating anchoring system as described in claim 9, wherein said veneer tie insertion end is selectively and compressively reduced in height to a combined height substantially less than said predetermined height of said bed joint.

11. A high-strength thermally-isolating anchoring system as described in claim 10, wherein said veneer tie insertion end is compressively reduced in height up to 75% of the original height thereof.

12. A high-strength thermally-isolating anchoring system as described in claim 11, wherein said veneer tie insertion end is fabricated from 0.250-inch diameter wire and wherein said wire formative is compressively reduced to a height of 0.175 inches.

13. A high-strength thermally-isolating anchoring system as described in claim 12, wherein said veneer tie insertion end has an upper surface and a lower surface, said upper surface, upon being compressively deformed, has a pattern of recessed areas impressed thereon for receiving mortar therewithin enabling said wall tie to securely hold to the mortar joint and increase the tie strength thereof.

14. A high-strength thermally-isolating anchoring system as described in claim 13, wherein said veneer tie insertion end further comprises:

a compression dimensioned to interlock with a reinforcement wire; and a reinforcement wire disposed in said compression;

whereby upon insertion of said reinforcement wire in said compression a seismic construct is formed.

15. A high-strength thermally-isolating anchoring system as described in claim 14, wherein said veneer tie attachment end is U-shaped for insertion in said veneer tie receptor.

16. A high-strength thermally-isolating anchoring system as described in claim 1, wherein the base portion is generally planar.

17. A high-strength thermally-isolating anchoring system as described in claim 1, wherein the stepped cylinder seal engages the base portion mounting surface and an insulation seal engages the base portion opposite the stepped cylinder seal.

18. A high-strength thermally-isolating anchoring system as described in claim 1, wherein the stepped cylinder seal is resiliently compressible.

19. A high-strength thermally-isolating anchoring system as described in claim 8, wherein the base portion is generally planar.

20. A high-strength thermally-isolating anchoring system as described in claim 8, wherein the stepped cylinder seal engages the base portion mounting surface and an insulation seal engages the base portion opposite the stepped cylinder seal.

* * * * *